United States Patent [19]

Whigham et al.

[11] Patent Number: 5,011,043

[45] Date of Patent: Apr. 30, 1991

[54] POST-MIX BEVERAGE DISPENSER VALVE WITH CONTINUOUS SOLENOID MODULATION

[75] Inventors: Roger C. Whigham, Atlanta; John H. Bearden, Marietta, both of Ga.

[73] Assignee: The Coca-Cola Company, Atlanta, Ga.

[21] Appl. No.: 370,371

[22] Filed: Jun. 23, 1989

Related U.S. Application Data

[62] Division of Ser. No. 58,448, Jun. 5, 1987, Pat. No. 4,884,720.

[51] Int. Cl.[5] ..... B67D 5/08

[52] U.S. Cl. ..... 222/63; 222/54; 222/129.3; 222/129.4; 222/504; 251/129.18; 251/285

[58] Field of Search ..... 222/54, 63, 129.1–129.4, 222/504; 251/129.18, 251, 263, 284, 285

[56] References Cited

U.S. PATENT DOCUMENTS

| | | | |
|---|---|---|---|
| 3,762,605 | 10/1973 | Seaton | 251/285 |
| 4,196,829 | 4/1980 | Seaton | 251/285 |
| 4,202,387 | 5/1980 | Upton | 222/54 |
| 4,342,443 | 8/1982 | Wakeman | 251/285 |
| 4,428,398 | 1/1984 | Mito et al. | 251/129.13 |
| 4,487,333 | 12/1984 | Pounder et al. | 222/54 |
| 4,499,920 | 2/1985 | Steffan et al. | 251/129.11 |
| 4,508,091 | 4/1985 | Wakeman | 251/285 |
| 4,884,720 | 12/1989 | Whigham et al. | 222/63 |
| 4,886,190 | 12/1989 | Kirschner et al. | 222/63 |

*Primary Examiner*—Joseph E. Valenza
*Assistant Examiner*—Steven Reim
*Attorney, Agent, or Firm*—Thomas R. Boston; W. Dexter Brooks

[57] ABSTRACT

A beverage dispenser valve system in which the mixture ratio is controlled by continuous modulation of the solenoid valves. The solenoid valves have a movable stop (or push rod) that controls the travel of the armature, which in turn controls the position of a needle valve with respect to the valve seat to gradually change the flow opening and thus the syrup and water flow rates. A microprocessor uses the movable stop to adjust the syrup and/or water flow rate to deliver the proper ratio of syrup to water based on the flow of water and syrup as measured by flow meters. In addition, the total flow rate from the nozzle can be controlled and varied in relation to the distance the cup lever arm is depressed, thus, the flow rate can be made slow at the beginning and end, and fast in-between.

1 Claim, 3 Drawing Sheets

POST-MIX BEVERAGE DISPENSER VALVE WITH CONTINUOUS SOLENOID MODULATION

This is a Divisional application of Ser. No. 07/058,448 filed on June 5, 1987, and now U.S. Pat. No. 4,884,720 of Dec. 5, 1989.

BACKGROUND OF THE INVENTION

1. Field of the Invention

This invention relates to post-mix beverage dispenser valves and more particularly to controlling the mixture ratio by modulating the flow rate of the water and syrup during operation.

2. Background

One well-known system for controlling the ratio of water to syrup in a beverage dispenser valve is to provide adjustable mechanical flow controls in each of the water and syrup conduits. These flow controls are used in conjunction with a solenoid valve in each conduit that opens when the valve is energized to dispense a beverage and which then closes after the beverage has been dispensed. A problem with such a system is that the mechanical flow controls need to be periodically adjusted to provide the correct ratio.

A more recent system (as described in U.S. Pat. No. 4,487,333, for example), controls the ratio automatically without the need for mechanical flow controls that require adjustment. This system uses solenoid valves in the water and syrup conduits that are intermittently turned on and off, independently, at prescribed duty cycles, to provide the desired mixture ratio.

SUMMARY OF THE INVENTION

A post-mix beverage dispenser valve system in which the mixture ratio is controlled by continuous modulation of at least one and preferably both of the solenoid valves during dispensing, in contrast to the intermittent on-off operation in U.S. Pat. No. 4,487,333. This continuous modulation is accomplished by continuously controlling the movement and thus the position of each of the solenoid armatures by means of a movable stop. Each of the armatures has a needle valve member at its distal end, and the flow rate past the valve seat is a function of the position of the needle valve member which in turn is a function of the length of travel of the armature. Both solenoids can be continuously modulated as to flow rate as described in this application, or one can be an on-off solenoid with only the other being adjustable.

Various means are described for providing the movable stop, such as a motor, gear and threaded rod, or a motor, gear, cam and cam follower.

Another aspect of the invention is that of controlling and varying the total flow rate from the nozzle in relation to the distance that the cup lever arm is pushed in. The ratio is controlled as described above, while at the same time the total overall flow is also controlled. This allows a large drink to be poured faster while reducing splashing and foaming by pouring more slowly at the beginning and end of the pour.

It is an object of the present invention to provide a post-mix beverage dispenser valve system using continuous modulation of the solenoid valve during dispensing to control mixture ratio.

It is another object to provide a solenoid valve for a post-mix dispenser valve having a continuously movable armature stop.

It is a still further object to overcome some of the problems with intermittent on-off solenoid operation.

It is another object of the present invention to provide a beverage dispenser valve with means for controlling and varying the total flow from the nozzle to provide a faster pour time.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENTS

Figure 1:
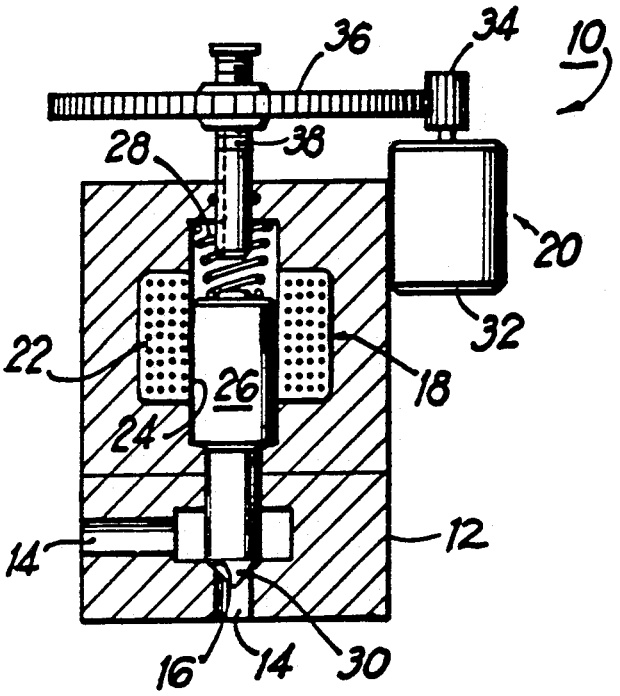
FIG. 1 is a partly cross-sectional side view of one embodiment of the adjustable flow solenoid valve of the present invention.

With reference now to the drawings, FIG. 1 shows a preferred adjustable flow solenoid valve 10 of the present invention. The valve 10 includes a body 12 having a conduit 14 therethrough and a valve seat 16, a solenoid 18 connected to the body 12 for controlling the flow through the conduit 14, and an adjustable flow control means 20.

The apparatus shown in FIG. 1 is substantially identical for both the water and the syrup conduits, although there may be minor differences in dimensions; for example, the water passageway would preferably be larger than the syrup passageway.

The solenoid 1B includes a solenoid coil 22, an armature tube 24, an armature 26, and a spring 28 biasing the armature to its closed position. The armature has a valve member 30 that engages the valve seat 16 to close off flow through the conduit 14. The valve member is preferably needle shaped to provide a gradual increase in the size of the opening depending on the position of the valve member (the amount of travel of the armature) when the solenoid is energized.

The adjustable flow control means includes a motor 32, such as a servo motor or a stepping motor, a pair of gears 34 and 36, and a threaded rod 38 which is threadingly connected to the gear 36 and includes a key-way so that it will move linearly in response to rotation of the gear 36. The rod 38 is the movable stop means for the armature 26.

Thus, the flow through the valve 10 when the solenoid 18 is energized is controlled by controlling the position of the rod 38. If a large flow rate is desired, the rod 38 is retracted; for a smaller flow, the rod 38 is moved downward (as viewed in FIG. 1).

Figure 2:
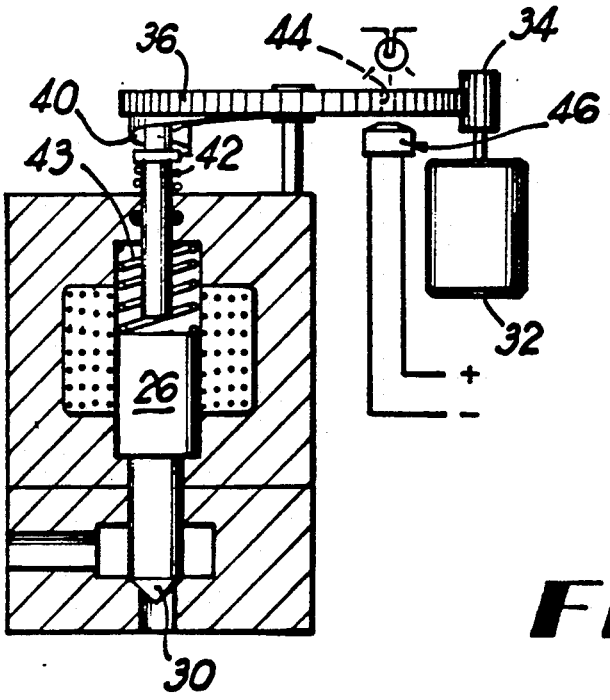
FIG. 2 is a partly cross-sectional side view of another embodiment of the present invention.

FIG. 2 shows another embodiment of the present invention which is similar to FIG. 1 except that the adjustable flow control means is a cam 40 on the bottom surface of the gear 36. The movable stop means is a cam follower rod 42 spring biased into contact with the cam 40. FIG. 2 also shows a means for establishing a home position for the adjustable flow means. This is preferably accomplished by a hole 44 in the gear 36 and a photoelectric unit 46. A similar means is preferably employed in each embodiment to establish a home position.

Figure 3:
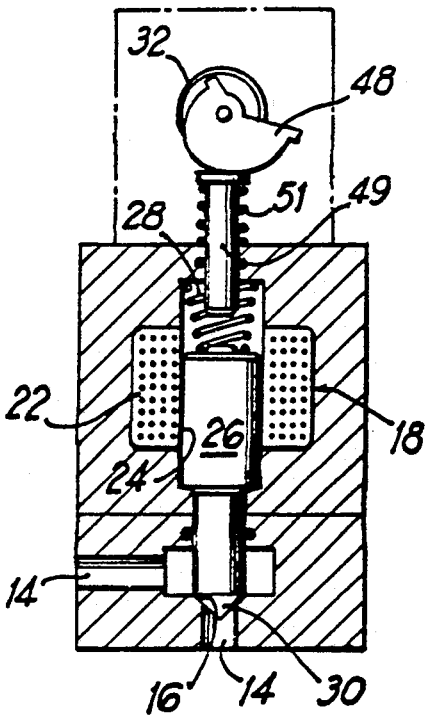
FIG. 3 is a partly cross-sectional side view of a still further embodiment of the present invention.

FIG. 3 shows another embodiment of the present invention which is similar to FIG. 1 except that the adjustable flow control means is a cam 48, and a cam follower 49 spring biased by a spring 51 into contact with the cam 48.

Figure 4:
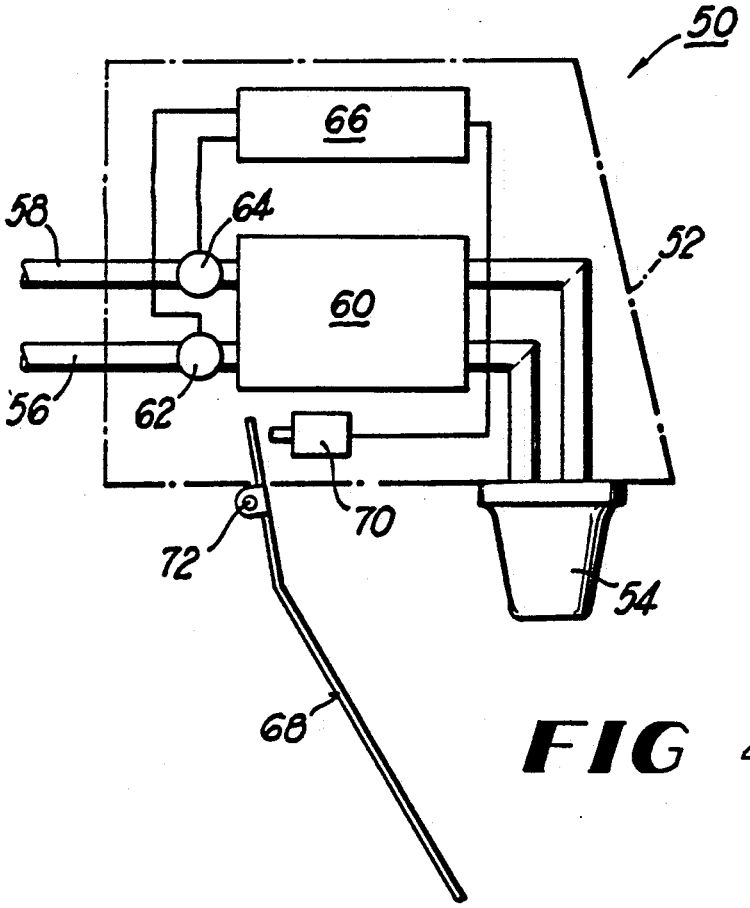
FIG. 4 is a partly diagrammatic, partly schematic side view of a beverage dispenser of the present invention using the adjustable flow solenoid valves of the present invention.

FIG. 4 shows a beverage dispenser valve 50 of the present invention including a cover 52, a nozzle 54, a syrup line 56, a carbonated water line 58, a continuously modulated solenoid valve unit 60 including a water solenoid and a syrup solenoid, a syrup flow meter 62, a water flow meter 64, a control means 66, a cup actuated lever arm 68 connected to a pivot 72, and a switch 70.

When a drink is to be dispensed, a cup is pushed against the arm 68 which moves and actuates the switch 70 to energize the two solenoids in the unit 60. Alternatively, the valve 50 can be a portion control valve or a self-service valve operated by a push button. The control means 66, in response to inputs from the flow meters 62 and 64 energizes (in each solenoid) the motor 32 to properly position the movable stop 38 to provide the desired flow rate for each of the syrup and water. The flow rate is automatically continuously controlled during dispensing to achieve the desired mixture ratio. The control means 66 can be, for example, as described in U.S. Pat. No. 4,487,333.

Figure 5:
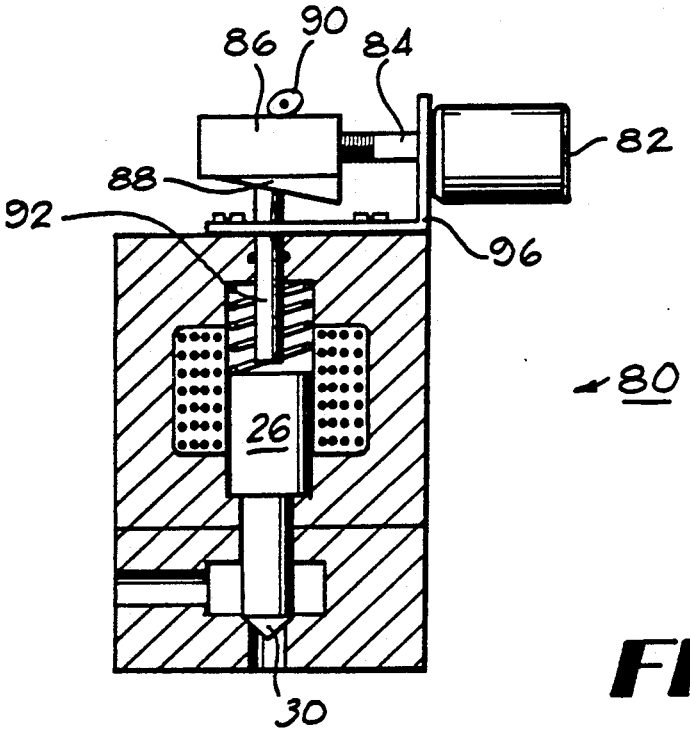
FIG. 5 is a partly cross-sectional side view of a preferred embodiment of the present invention.

FIG. 5 shows the preferred embodiment of the solenoid valve 80 of the present invention which is similar to FIGS. 1-3 except that the motor 82 is turned sideways and has a threaded rod 84 extending through a threaded opening in a cam holder 86 having a cam surface 88. A roller 90 provides a downward force on the holder 86. A push rod 92 (the movable stop) is biased with contact with the cam surface 88 by a spring 94. The cam holder 86 is slidably connected to a motor bracket 96.

Figure 6:
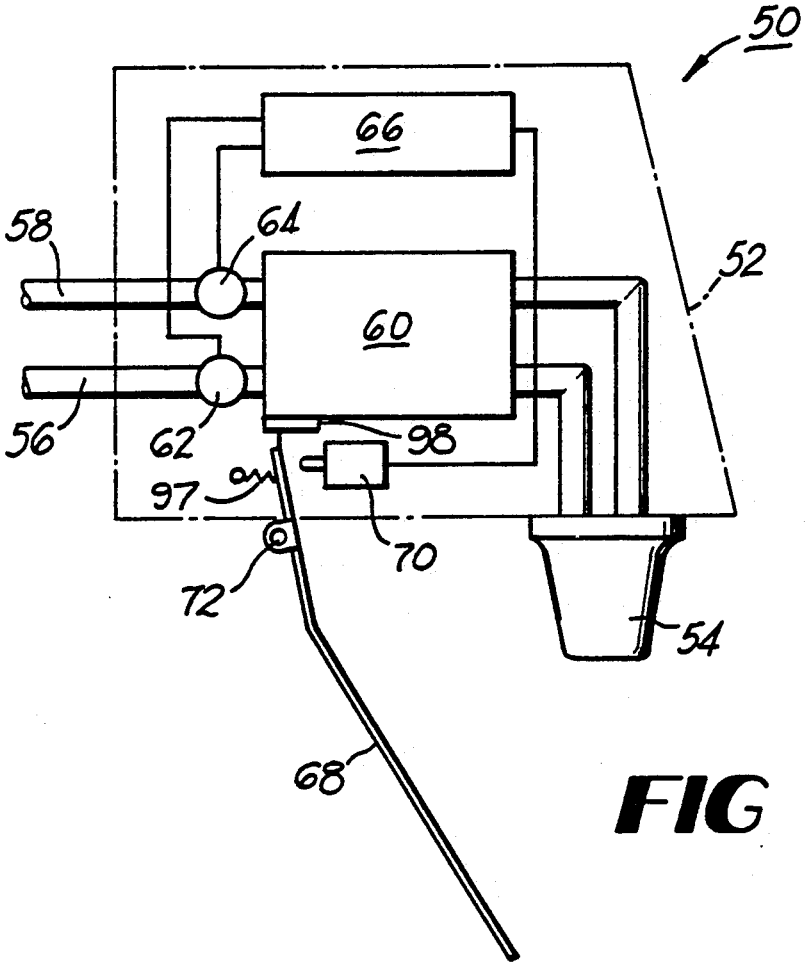
FIG. 6 is a partly diagrammatic, partly schematic side view of a beverage dispenser of the present invention having means for controlling and varying the total flow rate from the nozzle.

FIG. 6 is a solenoid valve similar to FIG. 4 except for the addition of a spring 97 and potentiometer 98. The control means includes means for moving both armatures in the correct proportion, to increase or decrease total flow from the nozzle.

The present invention provides for continuous operation of the solenoids at reduced flow levels rather than intermittent on/off operation, thus reducing the number of operating cycles required for dispensing a given number of drinks. The modulation of valve flow rate occurs during operation. This allows the water/syrup ratio dispensed by the valve to be continuously monitored and adjusted.

The embodiments described above preferably use a stepper motor to drive the modulation linkage. Other drive actuators such as linear servos, air and hydraulic cylinders, and servo motors can alternatively be used. The stepper motors have proven to be the best actuation mechanism due to cost, size, and ease of control with a small digital circuit. The armature 26 can be made by modifying the previously used armature by the addition of a stainless steel needle with an "O"-ring to seal on the existing valve seat. This needle will have the appropriate taper to allow for total flow modulation with about ⅛ inch of armature travel. The movable stop (or push rod) can pass through the existing solenoid body and through the center of the armature spring to contact on the armature. This movable stop (or push rod) can then pass through a seal at the top of solenoid body to prevent fluid leakage. The seal can seat in a counterbore, flush with the top of the solenoid body. A bracket to support the adjustable flow control means can also serve as the seal retainer.

The purpose of each embodiment is to provide continuous control of the position of the armature and its needle valve. This will in turn control the flow rate through the valve. All embodiments described will adjust the position of the armature/needle valve with the solenoid energized, thus allowing for continuous flow modulation without cycling the solenoid coil. This will increase solenoid life and allow for the use of less expensive solenoids.

Regarding FIGS. 1 and 2, the home position required by the electronic positioning circuitry is found by use of a photodetector and a small hole in the driven gear, as shown in FIG. 2. Upon start up, the control circuit will rotate the driven gear in a specified direction until the detector senses the hole indicating the home position has been found. Regarding the embodiment of FIG. 3, the cam is cut for full control of the push rod travel, thus having the ⅛ inch of travel in slightly less than one revolution. The expected loads on the system are low, so the use of a UHMW polyethylene tip on the push rod is sufficient.

While the preferred embodiments of this invention have been described above in detail, it is to be understood that variations and modifications can be made therein without departing from the spirit and scope of the present invention. For example, while a pull solenoid has been described, it is also possible to use a push solenoid.

What is claimed is:

1. A beverage dispenser valve comprising:

(a) a water conduit and a separate syrup conduit, each including a valve seat;

(b) a solenoid valve associated with each of said conduits for controlling the flow therethrough, at least one of said solenoid valves being adapted for continuous modulation and including an armature with a graduated flow control valve member on its distal end adapted to contact a valve seat to close the respective conduit to flow therethrough when said solenoid valve is de-energized;

(c) means for energizing said solenoid valves to open them when it is desired to dispense a drink from said dispenser valve;

(d) at least one of said solenoid valves including continuously movable stop means for positioning said armature at any position between its two end positions when said solenoid valves are energized, such that the area of the flow opening through said valve seat can be continuously controlled by moving said stop means any desired distance;

(e) means for moving said movable stop means any desired amount to control the flow through at least one solenoid valve; and (f) said moving means including a motor, a cam connected to said motor, and a linearly movable stop spring biased into contact with said cam.

* * * * *